United States Patent [19]

Hapel

[11] 4,262,463

[45] Apr. 21, 1981

[54] PRESSED BLOCKS FOR INTERLOCKED ASSEMBLY

[75] Inventor: Joseph Hapel, Seine Maritime, France

[73] Assignee: Bureau d'Etudes Techniques J. Hapel & Cie Ingenieurs Conseils Chillou, Le Havre, France

[21] Appl. No.: 973,557

[22] Filed: Dec. 27, 1978

[51] Int. Cl.[3] ..... E04C 1/10

[52] U.S. Cl. ..... 52/98; 52/505; 52/594

[58] Field of Search ..... 52/98, 593–595, 52/503–505

[56] References Cited

U.S. PATENT DOCUMENTS

| | | | |
|---|---|---|---|
| 390,175 | 9/1888 | Lee | 52/594 |
| 1,959,816 | 5/1934 | Crum | 52/98 |
| 2,019,653 | 11/1935 | Buyer | 52/595 |
| 2,271,079 | 1/1942 | Kieser | 52/98 |
| 2,695,512 | 11/1954 | Paquet | 52/98 |
| 2,911,818 | 11/1959 | Smith | 52/594 |
| 3,305,982 | 2/1967 | Steele | 52/90 |
| 3,618,279 | 11/1971 | Sease | 52/594 |
| 3,905,170 | 9/1975 | Huettemann | 52/593 |

FOREIGN PATENT DOCUMENTS

| | | | |
|---|---|---|---|
| 724213 | 5/1969 | Belgium . | |
| 915121 | 7/1946 | France . | |
| 1065440 | 5/1954 | France | 52/98 |
| 270011 | 5/1927 | United Kingdom | 52/594 |

*Primary Examiner*—J. Karl Bell

*Attorney, Agent, or Firm*—Sandler & Greenblum

[57] ABSTRACT

A block having opposite first and second faces adapted for use in construction. The block comprises male and female assembly means for interlocking a plurality of the blocks. The block comprises at least one male assembly means protruding from the first face. Each of the male assembly means has a vertical section and two substantially horizontal sections arranged at both ends of the vertical section. The female assembly means is arranged on the second face of the block and has a substantially rectangular cross-section.

A block for use in construction. The block comprises assembly means for interlocking a plurality of the blocks. The assembly means comprise first and second opposite faces provided with at least one male assembly means and one female assembly means. The male assembly means comprises a frangible section.

The block covered by the invention offers the special advantage of permitting walls to be built by simple superimposition.

12 Claims, 15 Drawing Figures

PRESSED BLOCKS FOR INTERLOCKED ASSEMBLY

Figure 1:
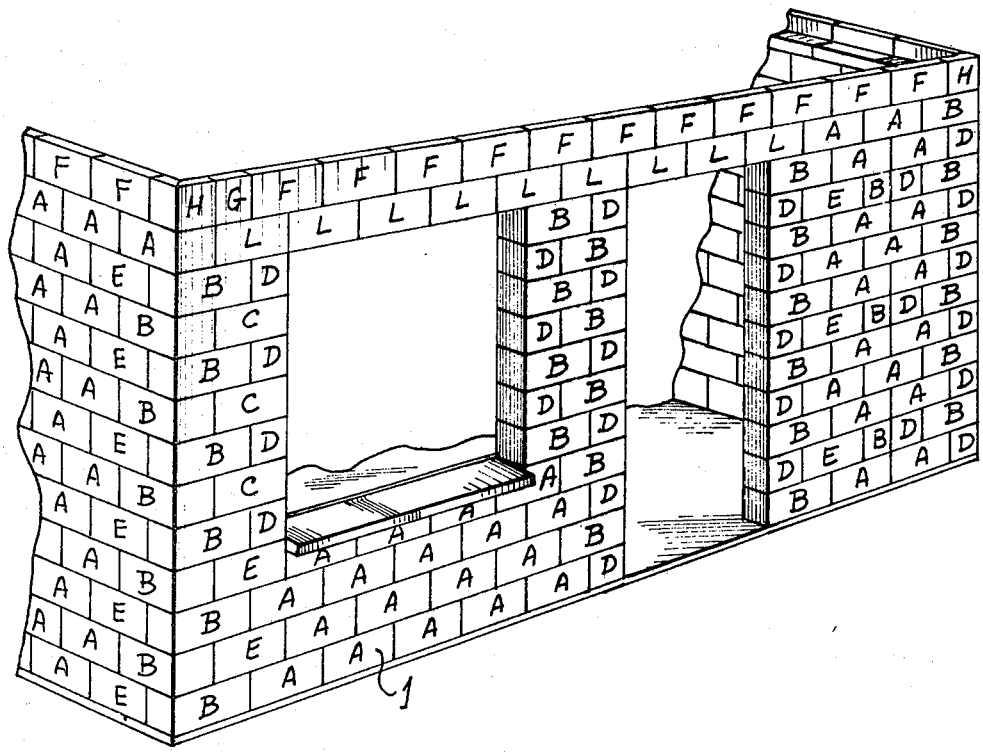

This invention covers a pressed modular element or block.

It is well-known that walls may be built by superimposing modular pressed blocks and offsetting them laterally. Generally, these pressed blocks are parallelepipedic in shape and are supported upon their top and bottom faces. To ensure the rigidity of the wall thus assembled, it is necessary to cement between the blocks by trowelling in, during construction, even layers of cement between each pair of blocks.

Further, in order to obtain a wall which is perfectly vertical, care should be taken to ensure that the blocks be set exactly above each other.

The construction of walls by using such blocks thus entails a certain degree of skill which implies a long apprenticeship. This apprenticeship is a definite handicap for those who have not had the to pursue it and whose services cannot, consequently, be offered contractors. It is, de facto, liable to slow down the expansion of construction industry.

This present invention aims at solving this problem. To this end and according to one of the characteristic features of the present invention, the said pressed block possesses assembly means for by interlocking the blocks. These means are complementary in form and are provided on the respective, opposed supporting faces which are in contact with the adjacent blocks.

The object of the invention may be fulfilled since:

on the one hand, the interlocking of the assembly means of ensures the rigidity of the group of superimposed blocks, on the other hand, the presence of means assembly which are complementary in shape ensures the perfect alignment and perpendicularity of the blocks.

Preferably, the assembly means are situated on the top and bottom bearing-surfaces of the blocks and comprise male and female elements of corresponding shape. Preferably also, in order to allow the lateral off-setting of successive layers, the assembly means situated on the top and bottom bearing-surfaces are arranged to this end. For this purpose, preferably, they are uniformly spaced. In particular, there are two of them per bearing-surface, arranged symmetrically and roughly centered on each half of the bearing-surfaces considered.

In one embodiment of the invention, particularly suited to the solution of problems involved in the mass-production of modular blocks and in accordance with a complementary feature, the male assembly means situated on the top bearing-surface are, when seen from above, 'I'-shaped and the female means on the lower bearing-surface are positioned on the opposite sides and are rectangular in shape.

It should be noted that the blocks covered by this invention may further be designed with a view to solving a complementary problem. There are instances where it is necessary to have an overall vertical rigidity of the wall which is greater than in others. To this end and in accordance with another characteristic feature of the present invention, the block also comprises internal hollow passages opening to the exterior through openings situated on the top and bottom bearing-surfaces. When erecting and assembling the blocks (using the means of assembly) one above the other, a shutteringarrangement results into which concrete may be poured and in which a metal armature may be placed. It is clear that by doing this, the rigidity of the wall and the strength of the assembly is increased without any need to resort to building techniques requiring great manual skill and considerable experience since the shuttering is obtained by merely superimposing blocks which are automatically centered (no error of erection being possible).

Preferably, in accordance with a subsidiary feature of the invention which allows, amongst other things, the positioning of horizontal metal reinforcement, the male assembly-means on the upper surfaces are made thinner locally so that they are frangible and may be easily broken at this point, in order that the metal reinforcement may be set in position there. In particular, where the male assembly-means are I-shaped, it is the vertical bar of the I which is locally narrowed.

We shall now describe in detail, without the description being restrictive, various embodiments of blocks covered by the invention, with reference to the drawings which show:

FIG. 1: perspective view of a wall built from pressed blocks according to the invention showing the different types of block which may be used in order to surmount difficulties concerning corners, openings, etc.

Figure 2:
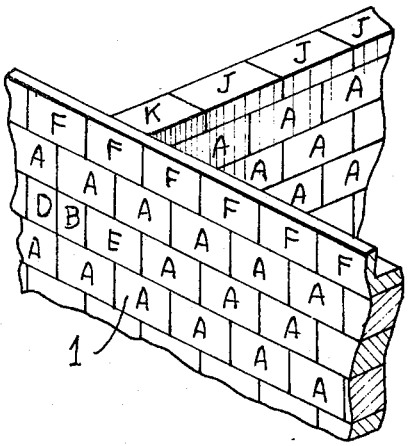

FIG. 2: perspective view of a T-shaped wall showing the position of other types of blocks.

Figure 3:
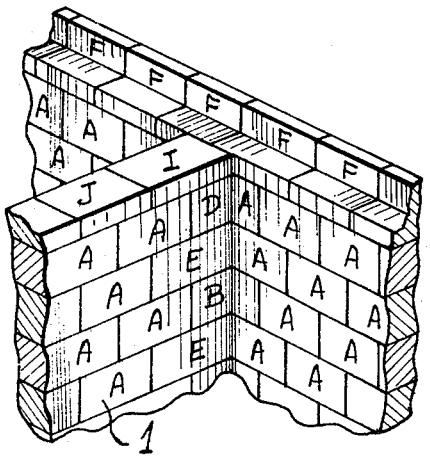

FIG. 3: perspective view of the wall shown in FIG. 2 seen from the inside, showing another type of block.

Figure 4:
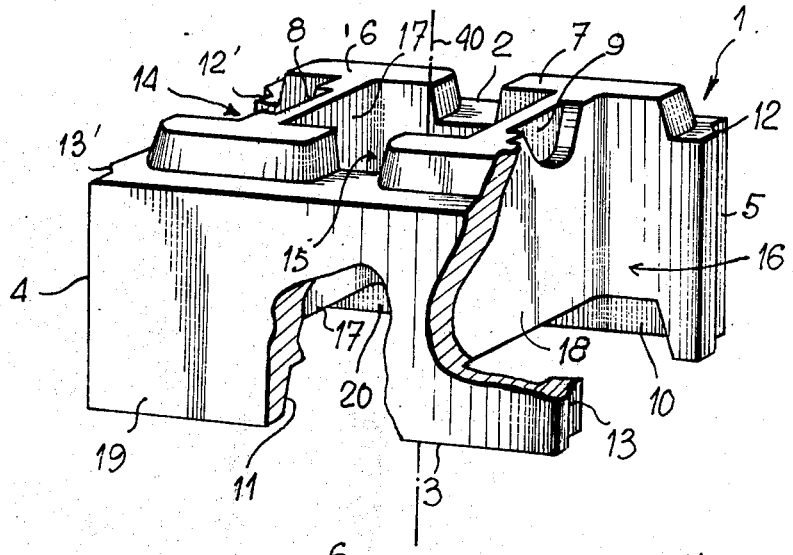

FIG. 4: open perspective view of a type A block used for building solid walls.

Figure 5:
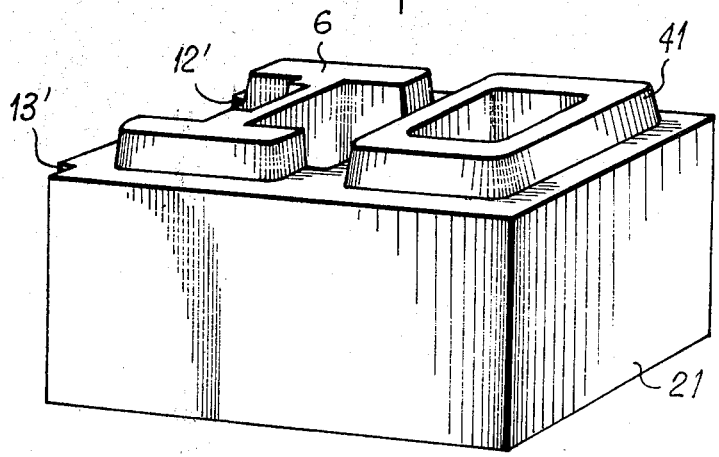

FIG. 5: perspective view of a type B block used for building a corner-wall.

Figure 6:
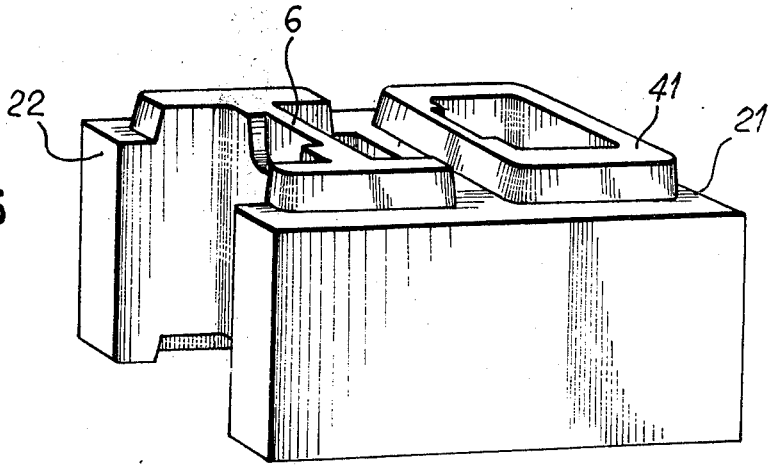

FIG. 6: perspective view of a type C block used for framing openings (windows and doors).

Figure 7:
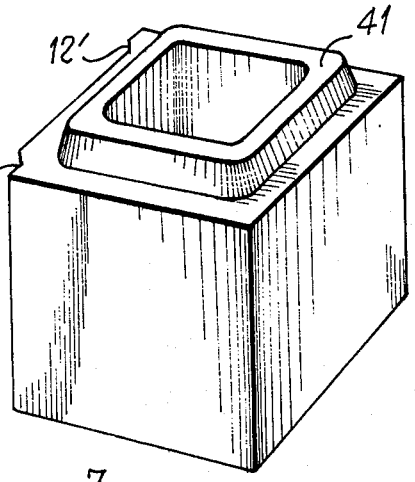

FIG. 7: perspective view of a type D block for framing openings.

Figure 8:
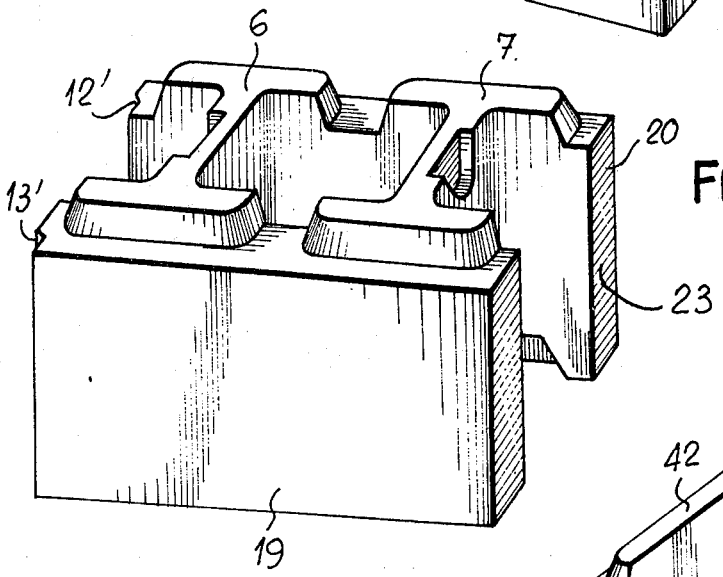

FIG. 8: perspective view of a type E block used especially for building a T-shaped wall such as is shown in FIG. 3.

Figure 9:
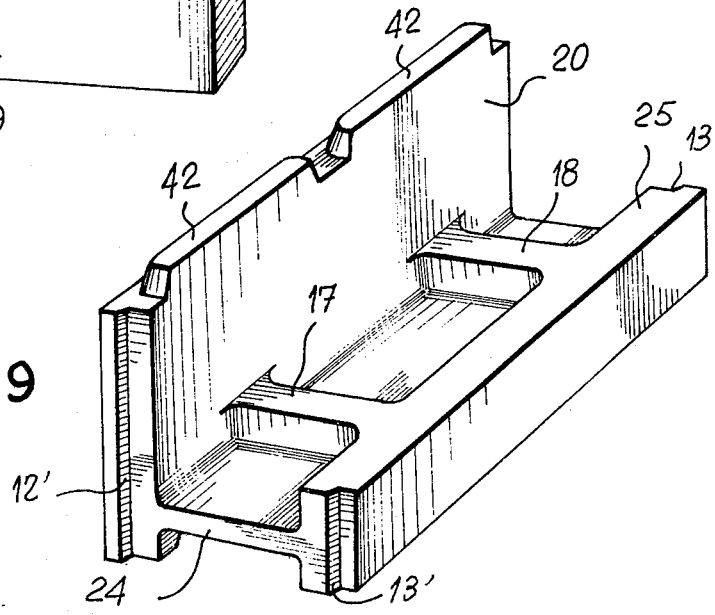

FIG. 9: perspective view of a type F block used for the execution of the header-course of a wall to be tied into a floor.

Figure 10:
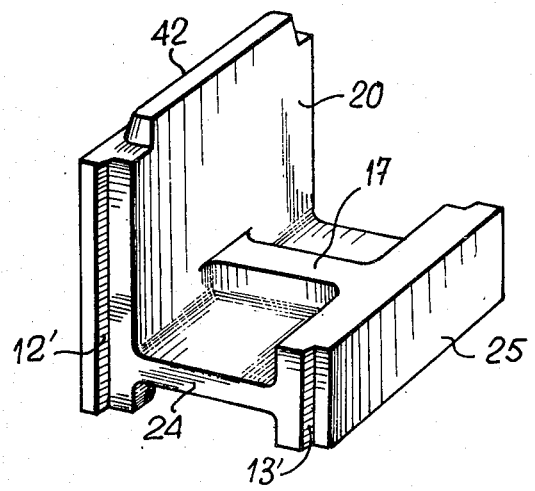

FIG. 10: perspective view of a type G block for the header-course of a wall to be tied into a floor and being half as long as a type F block.

Figure 11:
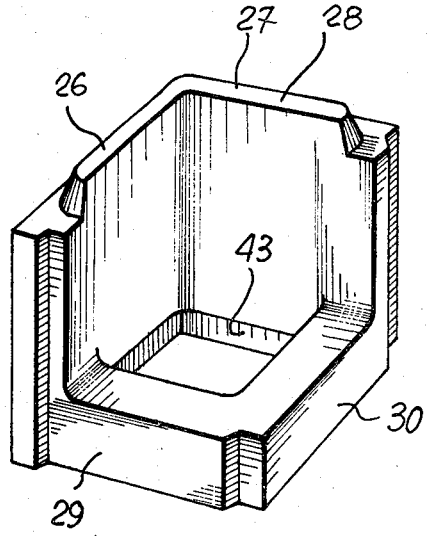

FIG. 11: perspective view of a type H block used for executing the corner of a wall header-course to be tied into a floor.

Figure 12:
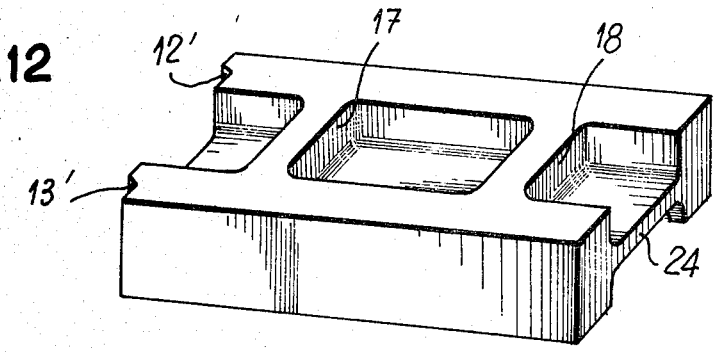

FIG. 12: perspective view of a type I block used for the header-course to be at under-floor level and suitable for a T-wall as shown in FIG. 3.

Figure 13:
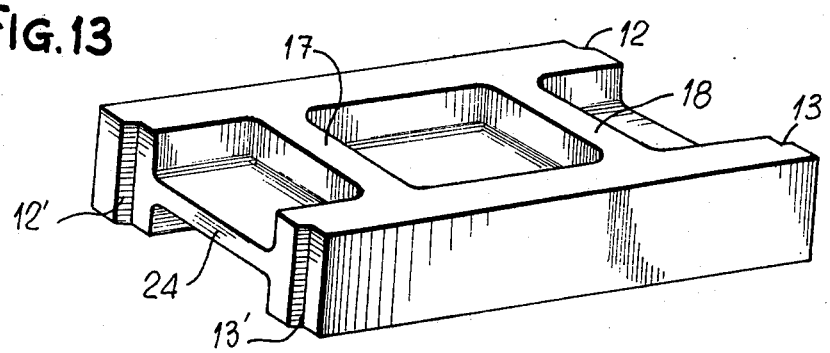

FIG. 13: perspective view of a type J block used for the header-course at under-floor level.

Figure 14:
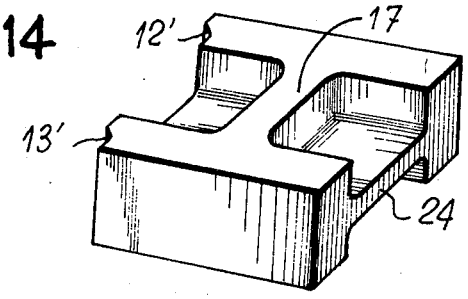

FIG. 14: perspective view of a type K block used for the header-course of a wall at under-floor level and being half as long as the type I block.

Figure 15:
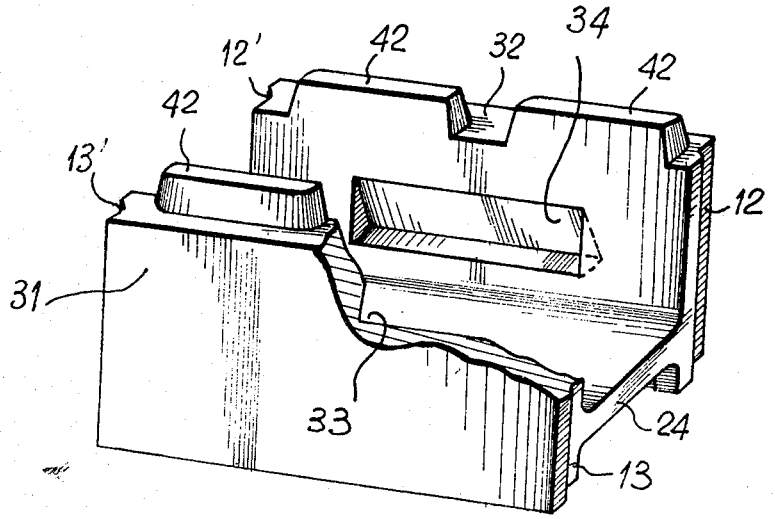

FIG. 15: perspective view of a type L block used for the lintel of a doorway.

FIGS. 1–3 illustrate building facades, each of the blocks being lettered according to their type. Each of these types of blocks will be described in detail with reference to FIGS. 4–15.

It is thus apparent that for the construction of a solid wall type A blocks are used; for the corner of a wall, type B or D blocks are used; for openings (doors and windows), B, D or C-type blocks are used (for the sides of openings) and type L (for the upper parts of openings); for T-walls, type E, B, A and D blocks are used; for the upper portions of a wall, type F, G, H, I, J and K blocks are used.

In FIG. 4, an open perspective-view illustrate a type A block, i.e. the most usual type as used for solid walls.

The pressed block of generally parallelepipedic shape (in particular, produced in dark brown shade, sizes 20×40 cm or 15×45 cm) has an upper or first support bearing-surface 2, a second or lower bearing-surface 3 and third and fourth lateral faces 4 and 5 designed to come into contact with the adjacent blocks. On the upper surface are arranged roughly symmetrically (about the vertical axis 40 of the block) two male assembly-means 6 and 7 having an I shape when seen from above (the vertical bar of each I being placed crosswise with reference to the length of the block); each male assembly-means 6 and 7 is respectively centred generally on each half of the upper bearing-surface 2 and projects upward beyond this upper surface. Each assembly means 6 and 7 is locally thinned at 8 and 9 on the vertical bar of the I (the reasons for this will be given below). As illustrated in FIGS. 4 through 6, the vertical bar of the "I" extends downwardly from beyond upper surface 2 to a point adjacent to lower surface 3 in order to form a plurality of open passageways within each block. As seen in FIG. 4, the vertical wall extends downwardly below the first face yet remains adjacent to and above the second face 3 of the block so as to form hollows or recesses 10 and 11. Accordingly, a hollow block with two open ends is formed.

On the lower bearing-surface 3 are placed symmetrically (about the vertical axis of symmetry of the block) two sets of female assembly means 10 and 11 executed in the form of hollow passages of a size corresponding to the dimensions of the male assembly means described above (in order to facilitate the erection of the blocks, a certain amount of play is allowed, between the male and female assembly-parts). The female assembly means 10 and 11 are arranged along the opposite sides of a square and are generally centred on each half of the lower bearing-surface 3.

The lateral third and fourth bearing-faces 4 and 5 also comprise male and female assembly-parts having shoulders 12, 13, 12' and 13' designed to thrust respectively against the complementary shoulders of adjacent blocks.

The inside of the block is hollow and pierced with vertical passages 14, 15 and 16 opening onto the upper and lower bearing-surfaces. Passages 14 and 16 open onto the lateral bearing-surfaces; the vertical or section bar of the I (of each male assembly means 8 and 9) extends internally downwardly at 17 and 18 as far as the level of the female assembly means 10 and 11 and defines the opening 15 in relation to openings 14 and 16.

The type A block is in the form of two vertical walls 19 and 20 which are generally parallel and connected by two vertical transverse walls 17 and 18 extending over almost the full height of the block.

We will now describe the manner in which block type A blocks act together when they are superimposed and offset so as to make walls such as those shown in FIGS. 1, 2 or 3.

When a type A block is set upon another type A block, the male assembly means such as 7 is engaged with the female assembly means such as 11 in the block placed above since; these male and female assembly means are of corresponding dimensions, it is obvious that once in position, neither block can move with respect to the other. It is also apparent that they will automatically be correctly placed in relation to each other. Further, as the male and female assembly means just described are evenly spaced over each of the support surfaces, as the distance between the centers of the two assembly means is roughly equal to the half-length of a block and as each assembly means is roughly centered on a half of the corresponding bearing-surface, it is apparent that type A blocks may be superimposed and regularly offset by one-half of the length of a block.

The completion of the assembly of several type A blocks results in a hollow passage or 'cavity' wall into which, if it is desired that it be strengthened, concrete may be poured after the possible introduction of a metal reinforcement.

By breaking the thinned frangible portions, defined above, which are placed on the vertical bar or section of the I forming the male assembly means, horizontal connection is made between openings 14, 15 and 16; it is then possible to place a horizontal metal reinforcement and pour concrete over the same; the rigidity of the wall is thus increased.

The type B block as shown in FIG. 5 differs from the type A insofar as one of the lateral support surfaces such as 21 is solid and planar. This face may thus be exposed; a type B block cannot therefore used on a corner.

The type B block differs also from the type A by the fact that the male assembly means adjacent to the lateral face 21, as seen from above, has a square shape. It extends downwardly as far as the female assembly means which is also square.

The type C block shown on FIG. 6 differs from the type B in that the other lateral bearing-face 22 is planar, i.e. it has no assembly means with shoulders; it is thus possible to place a type C block against walls 19 or 20 of a type A block.

A type D block as shown in FIG. 7 differs from a type B insofar as it is of half-size and only has a single assembly means per upper and lower bearing-surface, these assembly means being roughly square in shape.

A type E block as shown in FIG. 8 differs from the type A block in that one of the lateral support faces (23) is flat but not solid, i.e. it has no shouldered assembly-part.

A type F block as shown in FIG. 9 differs from the A-type mainly by the fact that one of the walls such as 19 has been half-eliminated from a certain height, that the only male assembly means remaining are the upper horizontal bar of the I 42, 42', and that it comprises a horizontal wall 24 connecting wall 20 with the remaining portion 25 of wall 19.

A type G block as shown in FIG. 10 differs from block F as shown in FIG. 9, by the fact that it is of half length and only comprises one male, and one female assembly means.

A type H block as shown in FIG. 11 comprises two vertical walls 26 and 27 set at right-angles to each other. On the vertical walls 26 and 27 are set male assembly means 28 in an L. On sides 29 and 30 having a height equal to the portion 25 of block F there are assembly means with shoulders. On the lower portion of vertical walls 26 and 27 and sides 29 and 30 there are square-shaped female assembly means 43.

A type I block as shown in FIG. 12 differs from the E-type by the fact that it comprises no male assembly means and is of lesser height and equal to portion 25 of block F.

A type J block as shown in FIG. 13 differs from the tye A in that it comprises no male assembly means and is of a lesser height equal to portion 25 of block F.

A type K block as shown in FIG. 14 differs particularly from type I in that it is of half length.

A type L block as shown in FIG. 15 comprises two vertical walls 31 and 32 and a horizontal wall 33; its cross section is U-shaped. At the upper and lower ends of walls 31 and 32 there are placed two male and two female assembly means and two female; laterally, on the sides, it comprises shoulders. Internally, the walls 31 and 32 have triangular openings 33 and 34 the function of which will be explained below.

This element is designed for the execution of lintels. The openings 33 and 34 serve to ensure the anchoring of the block to the R.C. lintel.

Items B–L have not been described in detail as they can all be understood from the type A block (items of identical or similar shape have the same references); on the basis of the information supplied regarding their specific use and with reference to the figures, a professional may deduce their details. It is, however, important to emphasize that all these blocks are designed to be used in conjunction. This means that their dimensions and shape are compatible (in particular, their dimensions are multiples and sub-multiples of the basic type A module). It should be emphasized that all the male and female assembly means of these types of blocks may be joined one to another even when they are not of exactly the same shape. As a result a certain number of assembly means are arranged only according to a fraction of the basic square shape (as it appears complete on the type D block); this, for example, is the case for the A type block. The male assembly means are arranged in relation to two opposite sides of the basic square and their median; the female assembly means are arranged in relation to two opposite sides of the basic square.

What is claimed is:

1. A block comprising opposite first and second faces and adapted for use in construction, said block further comprising at least one male and at least one female assembly means for interlocking a plurality of said blocks wherein:

(a) said at least one male assembly means protrudes above said first face and has a vertical section extending between two substantially horizontal sections arranged at the ends of said vertical section, said male assembly means having an "I" configuration, a portion of said vertical section extending downwardly below said first face; and (b) said at least one female assembly means is arranged on said second face and has a generally rectangular cross-section.

2. The block as defined by claim 1 wherein each of said vertical sections is provided with a frangible section, said frangible section being adapted such that when said frangible section is broken away to provide a broken away portion, said broken away portion is adapted to receive horizontal reinforcement means.

3. The block as defined by claim 2 wherein said frangible sections project above said first face.

4. The block as defined by claim 2 wherein said frangible section comprises a portion of said vertical section having a smaller thickness than the remainder of said vertical section.

5. The block as defined by claim 4 further comprising two male assembly means and wherein a section of each of said vertical sections comprises one of said frangible sections, and each of said frangible sections is arranged such that when each of said frangible sections is broken away to provide said broken away portions, said broken away portions are adapted to receive horizontal reinforcement means.

6. The block as defined by claim 5 wherein said vertical sections divide said block into three passages, each of said passages extending from said first to said second face, and wherein each of said passages is adapted to receive vertical reinforcement means.

7. The block as defined by claim 6 wherein each of said male assembly means has an "I" configuration.

8. The block as defined by claim 6 wherein each vertical section extends downwardly from above said first face to a point adjacent to and above said second face, said female assemblies comprising hollows.

9. The block as defined by claim 1 wherein said at least one male assembly means comprises a first male assembly means having an "I" configuration and a second male assembly means having a square configuration.

10. The block as defined by claim 9 wherein said block is a parallelpiped having lateral third and fourth faces perpendicular to said first and second faces and said third face comprises a wall while said fourth face comprises no wall.

11. The block as defined by claim 7 wherein each vertical section extends downwardly to a point adjacent to and above said second face.

12. The block as defined by claim 1 whercin said block is hollow and has two opposed open ends.

* * * * *

UNITED STATES PATENT AND TRADEMARK OFFICE

CERTIFICATE OF CORRECTION

PATENT NO. : 4,262,463

DATED : April 21, 1981

INVENTOR(S) : Joseph HAPEL

It is certified that error appears in the above—identified patent and that said Letters Patent is hereby corrected as shown below:

In the identification of the Assignee, "Chillou" should be deleted.

Column 1, line 22, after "offered", --to-- should be inserted;
line 23, "the" should be deleted;
line 24, after "of", --the-- should be inserted;
line 30, after "supporting", -- - -- should be inserted;
line 33, before "on", -- - -- should be inserted;
line 34, "of" (first occurrence) should be deleted; and
line 36, before "on", -- - -- should be inserted.

Column 2, line 13, after "assembly", "-" should be deleted; and
line 17, after "assembly", "-" should be deleted.

Column 3, line 15, after "assembly", "-" should be deleted;
line 18, after "assembly", "-" should be deleted; and
line 41, "centred" should be --centered--.

Column 4, line 27, after "therefore", --be-- should be inserted.

UNITED STATES PATENT AND TRADEMARK OFFICE

CERTIFICATE OF CORRECTION

PATENT NO. : 4,262,463

DATED : April 21, 1981

INVENTOR(S) : Joseph HAPEL

It is certified that error appears in the above—identified patent and that said Letters Patent is hereby corrected as shown below:

Column 5, line 2, "tye" should be -- type --; and line 10, "and two female" should be deleted.

Signed and Sealed this

*Eighteenth* Day of *August 1981*

[SEAL]

*Attest:*

GERALD J. MOSSINGHOFF

*Attesting Officer*

*Commissioner of Patents and Trademarks*